US006168476B1

(12) United States Patent
Yang

(10) Patent No.: US 6,168,476 B1
(45) Date of Patent: Jan. 2, 2001

(54) ELECTRICAL CONNECTOR

(75) Inventor: Sheng-Ho Yang, Taipei Hsien (TW)

(73) Assignee: Advanced Connecteck, Inc., Taipei Hsien (TW)

( * ) Notice: Under 35 U.S.C. 154(b), the term of this patent shall be extended for 0 days.

(21) Appl. No.: 09/429,714

(22) Filed: Oct. 29, 1999

(51) Int. Cl.[7] ..... H01R 13/502; H01R 13/58; H01R 13/627

(52) U.S. Cl. ..... 439/696; 439/467; 439/687; 439/352

(58) Field of Search ..... 439/465, 467, 439/696, 687, 345, 352, 333

(56) References Cited

U.S. PATENT DOCUMENTS 4,449,778 * 5/1984 Lane ..... 439/610
4,596,432 * 6/1986 Tighe, Jr. ..... 439/466
4,641,906 * 2/1987 Olsson ..... 439/465
5,173,057 * 12/1992 Bunch et al. ..... 439/217

* cited by examiner

*Primary Examiner*—Paula Bradley
*Assistant Examiner*—Edwin A. León
(74) *Attorney, Agent, or Firm*—Merchant & Gould P.C.

(57) ABSTRACT

An electrical connector includes a dielectric terminal mounting seat, a contact terminal set mounted in the terminal mounting seat, a metal shield enclosing the terminal mounting seat, and a dielectric casing enclosing the metal shield. The terminal mounting seat includes a base member and a cover member. The base member includes a bottom wall with front and rear portions. The contact terminal set is mounted on the bottom wall, and extends from the front portion to the rear portion. The base member further has a top side formed with an opening. The cover member is mounted movably on the base member so as to close the opening and so as to clamp the contact terminal set against the base member.

11 Claims, 5 Drawing Sheets

ELECTRICAL CONNECTOR

BACKGROUND OF THE INVENTION

1. Field of the Invention

The invention relates to an electrical connector, more particularly to one that complies with the IEEE 1394 standard.

2. Description of the Related Art

Electrical connectors that comply with the IEEE 1394 standard are generally used in 8 mm video cameras. Referring to FIG. 1, a conventional IEEE 1394 electrical connector is shown to comprise a terminal mounting seat 10 formed with a terminal receiving cavity 100 for receiving a contact terminal set 11 therein, a metal shield 12 that encloses the terminal mounting seat 10 and that serves as an electromagnetic interference shield, and a dielectric casing 13 that encloses the metal shield 12 to facilitate handling of the electrical connector.

Some of the drawbacks that arise during the manufacture of the conventional electrical connector of FIG. 1 are as follows:

1. The terminal mounting seat 10 is formed integrally using die casting techniques. The design of the mold for forming the terminal mounting seat 10 is relatively complex in view of the need to form the terminal receiving cavity 100 for receiving the contact terminal set 11, and in view of the need to ensure that the metal shield 12 can fittingly enclose the terminal mounting seat 10. Moreover, because the terminal mounting seat 10 has a relatively small size, the terminal receiving cavity 100 is also relatively small, thereby increasing the difficulty in designing and making the mold for forming the terminal mounting seat 10 with a high degree of precision. Because the mold for forming the terminal mounting seat 10 is very laborious and time-consuming to design, the mold has a very high cost that increases substantially the cost for manufacturing the aforesaid conventional electrical connector.

2. The terminals 110 of the contact terminal set 11 are in the form of elongate strips. Because the terminal receiving cavity 100 is relatively small, the distance between cable connecting portions 111 of adjacent terminals 110 of the contact terminal set 11 is also very small when the latter is mounted in the terminal mounting seat 10. Thus, short-circuiting can easily occur when a multi-wire cable 14 is connected to the cable connecting portions 111 of the terminals 110 due to the absence of sufficient spacing.

3. Precise engagement among the various components of the aforesaid conventional electrical connector is needed to ensure stability of the same. However, the various components of the electrical connector lack means for effectively preventing relative movement thereamong in the horizontal and vertical directions. Thus, undesired disengagement among the various components of the conventional electrical connector usually occurs.

SUMMARY OF THE INVENTION

Therefore, the main object of the present invention is to provide an IEEE 1394 electrical connector that can be fabricated using a mold with a relatively simple design to result in lower manufacturing costs.

Another object of the present invention is to provide an IEEE 1394 electrical connector having terminals that can be adequately spaced apart to avoid short-circuiting when a multi-wire cable is connected thereto.

A further object of the present invention is to provide an IEEE 1394 electrical connector having components that can be prevented from relative movement in the horizontal and vertical directions.

According to the present invention, an electrical connector includes a dielectric terminal mounting seat, a contact terminal set mounted in the terminal mounting seat, a metal shield enclosing the terminal mounting seat, and a dielectric casing enclosing the metal shield.

The terminal mounting seat includes a base member and a cover member. The base member includes a bottom wall with front and rear portions. The contact terminal set is mounted on the bottom wall and extends from the front portion to the rear portion of the bottom wall. The base member further has a top side formed with an opening. The cover member is mounted movably on the base member so as to close the opening and so as to clamp the contact terminal set against the base member.

Preferably, the contact terminal set includes a plurality of terminals, each of which has an elongate connector mating portion, an elongate cable connecting portion, and an intermediate angled portion that interconnects the connector mating portion and the cable connecting portion such that the distance between the cable connecting portions of adjacent ones of the terminals is greater than that between the connector mating portions.

In the preferred embodiment, various engaging, retaining and locking units are employed to guard against relative movement among the base and cover members of the terminal mounting seat, the contact terminal set, the metal shield and the dielectric casing in the horizontal and vertical directions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
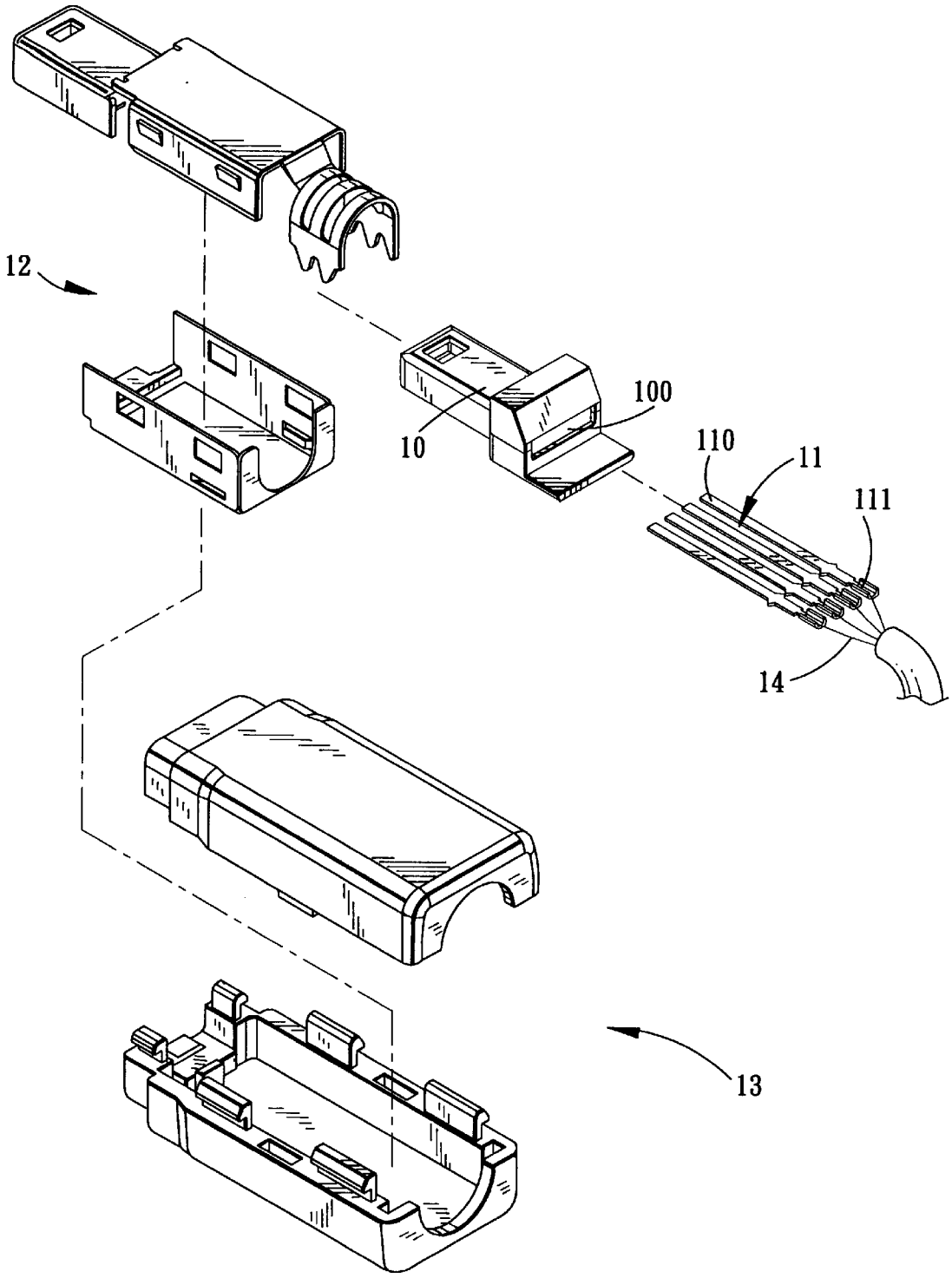
FIG. 1 PRIOR ART
FIG. 1 is an exploded perspective view illustrating a conventional electrical connector that complies with the IEEE 1394 standard.
Figure 2:
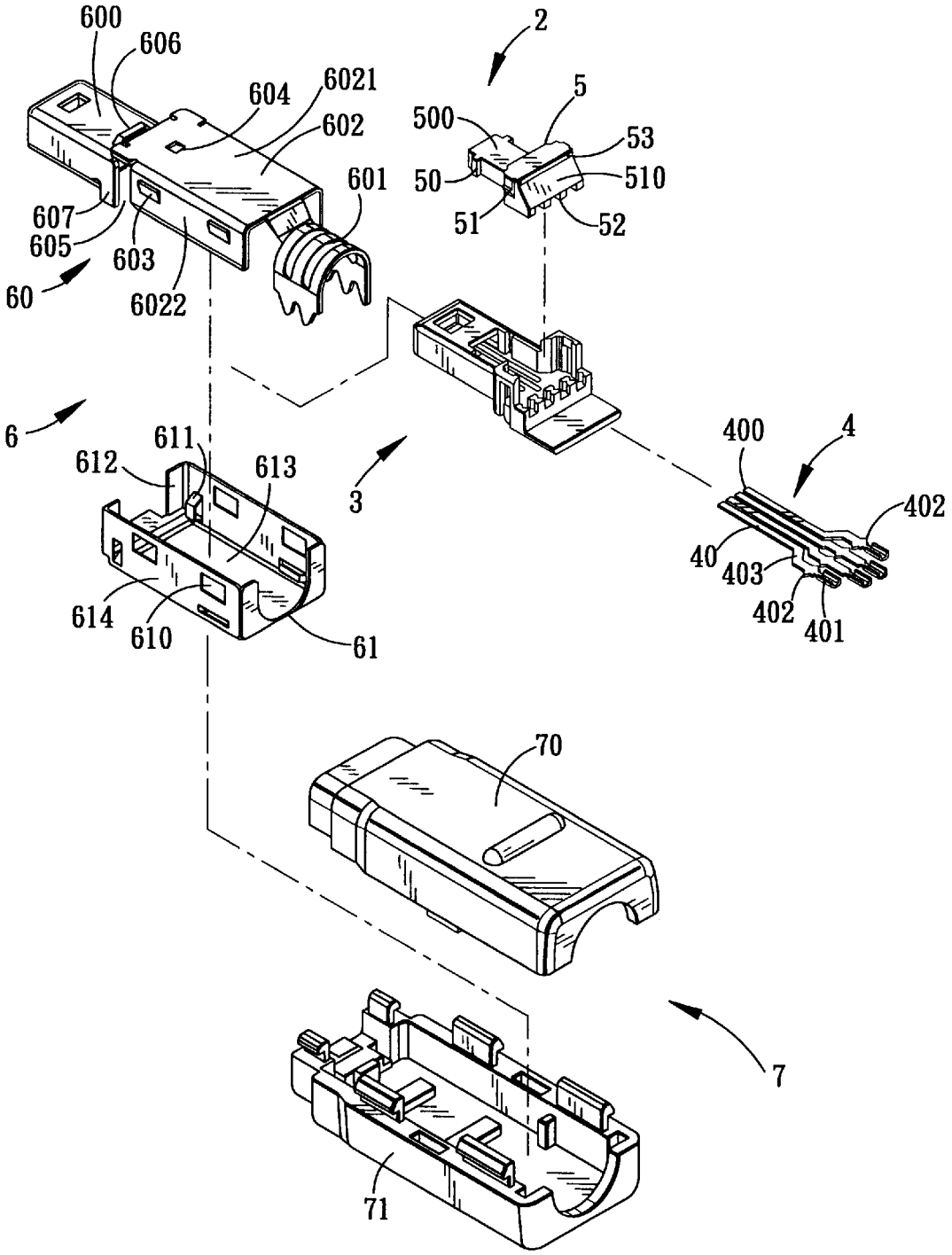
FIG. 2 is an exploded perspective view illustrating the preferred embodiment of an electrical connector according to the present invention.
Figure 3:
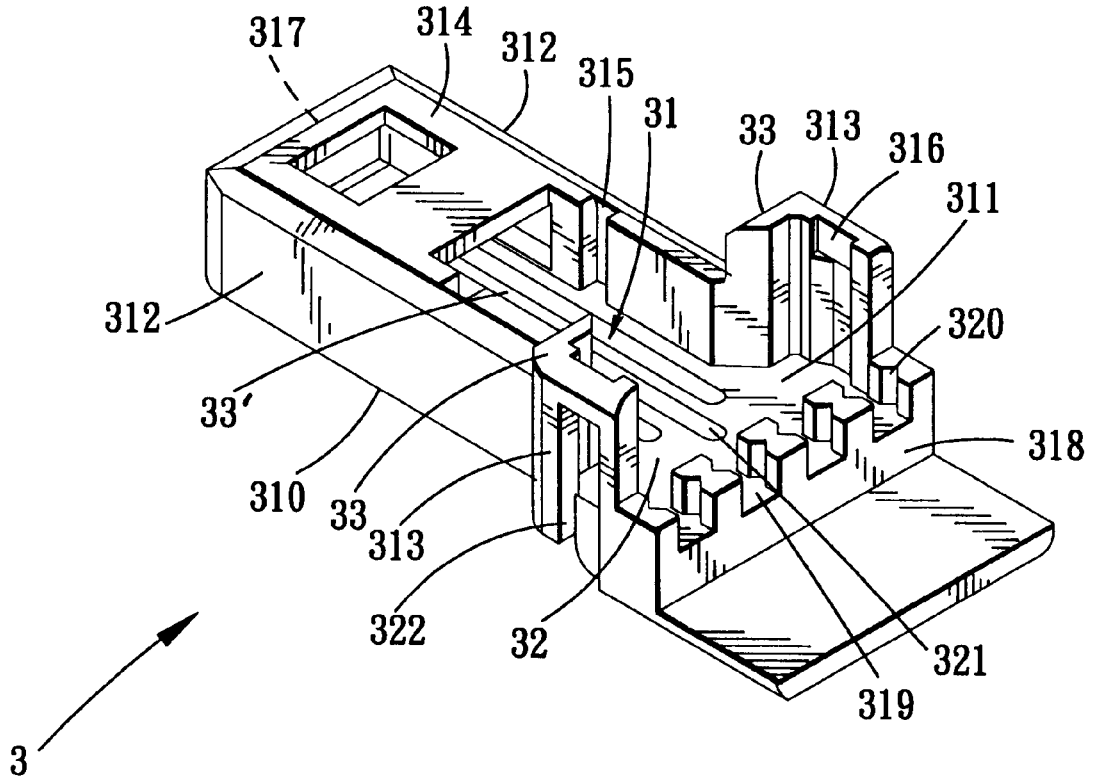
FIG. 3 is a perspective view of a base member of the preferred embodiment.
Figure 4:
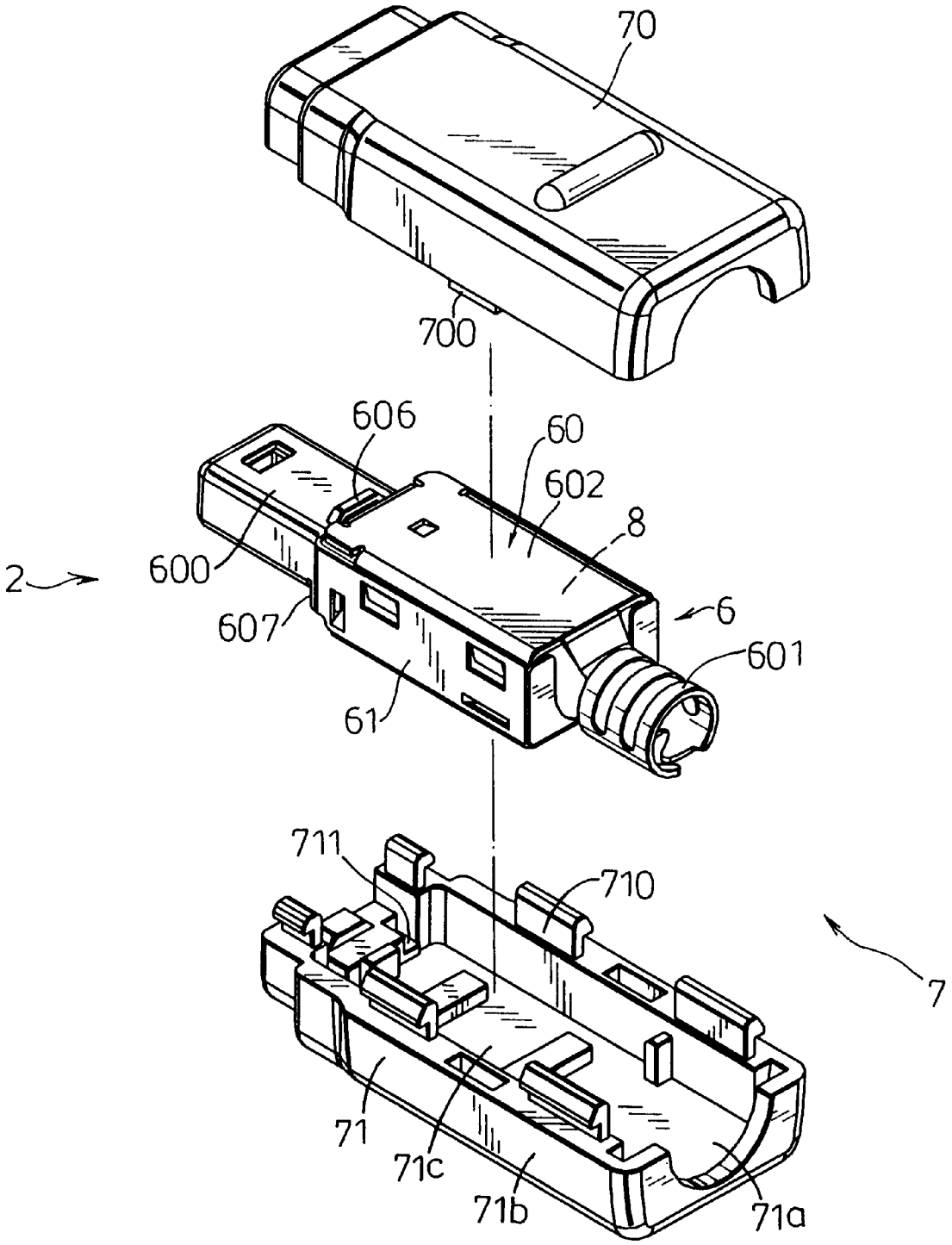
FIG. 4 is a partly exploded perspective view of the preferred embodiment.

Referring to FIGS. 2 to 4, the preferred embodiment of an electrical connector 2 that complies with the IEEE 1394 standard in accordance with this invention is shown to comprise a dielectric terminal mounting seat 8, a contact terminal set 4, a metal shield 6 and a dielectric casing 7.

The terminal mounting seat 8 includes a base member 3 and a cover member 5. The base member 3 includes a bottom wall 31 with a front portion 310 and a rear portion 311 that is wider than the front portion 310 in a transverse direction A pair of first side walls 312 extend upwardly from opposite lateral edges of the front portion 310. A pair of second side walls 313 extend upwardly from opposite lateral edges of the rear portion 311. The bottom wall 31 and the first and second side walls 312, 313 cooperate to confine a terminal receiving cavity 32 that extends in a longitudinal direction. The first side walls 312 have front sections with top edges that are interconnected by a top wall 314. The bottom wall 31, the front sections of the first side walls 312, and the top wall 314 cooperate to confine a front insert hole 317. The front portion 310 of the bottom wall 31 is formed with three terminal spacing projections 321 that extend in the longitudinal direction and that are spaced apart from each other in the transverse direction. The top edges of rear sections of the first side walls 312 and the top edges of the second side walls 313 cooperate to form an opening 33' for access to the terminal receiving cavity 32. The rear sections of the first side walls 312 have confronting inner surfaces provided with a first engaging unit in the form of an aligned pair of vertically extending key grooves 315. The second side walls 313 have confronting inner surfaces provided with a second engaging unit in the form of an aligned pair of hook projections 316, and outer surfaces provided with a first shield retaining unit in the form of a pair of vertically extending key ways 322. A terminal aligning wall 318 projects upwardly from the rear portion 311 of the bottom wall 31, and extends in the transverse direction to interconnect lower portions of the second side walls 313. The terminal aligning wall 318 has a top side formed with four terminal retaining notches 319. Each of the terminal retaining notches 319 is defined by a pair of vertical walls provided with a first retaining unit in the form of a pair of vertically extending V-shaped grooves 320.

The contact terminal set 4 includes four terminals 40, each of which has an elongate connector mating portion 400 and an elongate cable connecting portion 401. The connector mating portion 400 is adapted to connect electrically with a corresponding terminal of a complementary connector (not shown) . The cable connecting portion 401 is adapted to be connected to a multi-wire cable (not shown) . Each terminal 40 further has an intermediate angled portion 403 that interconnects the connector mating portion 400 and the cable connecting portion 401 such that the connector mating portion 400 and the cable connecting portion 401 are out of alignment. By virtue of the angled portions 403, the distance between the cable connecting portions 401 of adjacent ones of the terminals 40 can be greater than that between the connector mating portions 400, thereby easing the connection of the electrical connector to a multi-conductor cable (not shown) to avoid the occurrence of short-circuiting. The cable connecting portion 401 of each terminal 40 further has opposite lateral edges provided with a second retaining unit in the form of a pair of tapered key projections 402.

The terminals 40 of the contact terminal set 4 are disposed in the terminal receiving cavity 32 by mounting the same on the bottom wall 31 such that the connector mating portions 400 of the terminals 40 are spaced apart by the terminal spacing projections 321 in the transverse direction, and such that the cable connecting portions 401 of the terminals 40 extend through the terminal retaining notches 319 in the terminal aligning wall 318, respectively. The key projections 402 on the cable connecting portion 401 of each terminal 40 slidingly engage the V-shaped grooves 320 in the walls of the respective terminal retaining notch 319 to ensure proper positioning of the terminals 40 on the base member 3. By virtue of the terminal spacing projections 321 and the engagement between the key projections 402 and the V-shaped grooves 320, horizontal movement of the terminals 40 inside the terminal receiving cavity 32 can be effectively prevented.

After disposing the terminals 40 in the terminal receiving cavity 32, the cover member 5 is mounted movably on the base member 3 so as to close the opening 33'. The cover member 5 includes a front section 500 to be disposed between the rear sections of the first side walls 312, and a rear section 510 to be disposed between the second side walls 313. The front section 500 has opposite lateral sides provided with a third engaging unit in the form of a pair of keys 50 for sliding engagement with the key grooves 315 in the first side walls 312. The rear section 510 has opposite lateral sides provided with a fourth engaging unit in the form of a pair of hook projections 51 that complement with and that serve to engage the hook projections 316 on the second side walls 313. The rear section 510 further has a top side formed with an abutment projection 53 that projects upwardly, and a bottom side formed with four press projections 52 that project downwardly and that are registered with the terminal retaining notches 319, respectively. The press projections 52 extend into the terminal retaining notches 319 to clamp the cable connecting portions 401 of the terminals 40 between the base member 3 and the cover member 5. Preferably, the press projections 52 are configured to further engage the V-shaped grooves 320 in the walls of the terminal retaining notches 319. Thus, by virtue of the engagement between the keys 50 and the key grooves 315, and the engagement between the press projections 52 and the terminal retaining notches 319, movement of the cover member 5 relative to the base member 3 in the horizontal direction can be effectively prevented. In addition, by virtue of the engagement between the hook projections 51, 316, vertical movement of the cover member 5 away from the base member 3 can be prevented as well. Thus, the base member 3 and the cover member 5 can be firmly secured to each other to form the terminal mounting seat 8 having the contact terminal set 4 mounted securely therein.

After securing the base member 3 and the cover member 5 to each other, the metal shield 6 is assembled to enclose the terminal mounting seat 8. The metal shield 6 includes complementary upper and lower shield parts 60, 61. The upper shield part 60 includes a front section 600, an intermediate section 602 and a cable clamping section 601. The front section 600 is used to enclose the front portion 310 of the bottom wall 31, the first side walls 312, and the top wall 314 of the base member 3. The front section 600 further encloses the front section 500 of the cover member 5. The intermediate section 602 extends rearwardly from the front section 600, and includes a top plate 6021 and a pair of lateral plates 6022 that extend downwardly from opposite lateral edges of the top plate 6021. The intermediate section 602 is used to enclose the rear section 510 of the cover member 5 and the second side walls 313 of the base member 3. Each of the lateral plates 6022 is punched to provide the same with a first shield engaging unit in the form of a pair of resilient locking tongues 603. The top plate 6021 is similarly punched to form a resilient pressing tongue 604. Each of the lateral plates 6022 has a front edge that forms a clearance 605 in the longitudinal direction with the front section 600. The cable clamping section 601 extends rearwardly from the intermediate section 602 and is used to clamp a section of the multi-wire cable (not shown) that is connected to the contact terminal set 4. The front section 600 has a top side formed with a positioning projection 606 that projects upwardly and that is disposed adjacent to the intermediate section 602. The front section 600 further has opposite lateral walls formed with a pair of downwardly extending locating strips 607 that are disposed adjacent to the intermediate section 602.

The lower shield part 61 includes a bottom plate 613 and a pair of side plates 614 that extend upwardly from opposite lateral edges of the bottom plate 613. The lower shield part 61 is used to enclose the bottom wall 31 of the base member 3 and the lateral plates 6022 of the upper shieldpart 60. The side plates 614 are punched to provide the same with a second shield engaging unit in the form of rectangular locking holes 610 for engaging the locking tongues 603. The side plates 614 are further punched to provide the same with a second shield retaining unit in the form of a pair of inwardly projecting keys 611 for sliding engagement with the key ways 322 in the second side walls 313. The side plates 614 have front ends that are bent inwardly in the transverse direction to form stop flanges 612 that abut respectively against a pair of shoulders 33 of the base member 3 that are formed between the first and second side walls 312, 313.

To assemble the metal shield 6 onto the terminal mounting seat 8, the terminal mounting seat 8 is initially disposed in the lower shieldpart 61 such that the keys 611 engage the key ways 322 and such that the stop flanges 612 abut against the shoulders 33 of the base member 3. Horizontal movement of the terminal mounting seat 8 inside the lower shield part 61 is thus prevented. Subsequently, the upper shield part 60 is installed such that the front section 600 thereof encloses the front portion 310 of the bottom wall 31, the first side walls 312, the top wall 314 of the base member 3, and the front section 500 of the cover member 5. With the pressing tongue 604 on the intermediate section 602 of the upper shield part 60 pressing against the abutment projection 53 on the cover member 5, the lateral plates 6022 of the intermediate section 602 are extended between the terminal mounting seat 8 and the side plates 614 of the lower shield part 61 such that the locking tongues 603 in the lateral plates 6022 extend into and engage the locking holes 610 in the side plates 614. Because of the clearances 605, the lateral plates 6022 do not interfere with the engagement between the keys 611 and the key ways 322. By virtue of the engagement between the locking tongues 603 and the locking holes 610, the upper and lower shield parts 60, 61 can be prevented from separating from each other in the vertical direction. The upper and lower shield parts 60, 61 can thus be securely connected to each other. In addition, due to the abutment between the abutment projection 53 and the pressing tongue 604, the cover member 5 can be biased toward the base member 3. Thus, the terminal mounting seat 8 can be stably retained within the metal shield 6.

Figure 5:
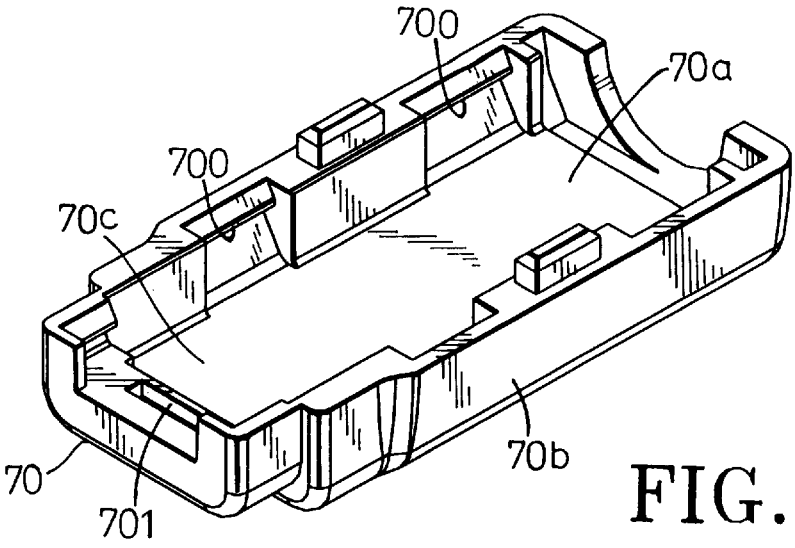
FIG. 5 is a perspective view showing an upper casing part of a dielectric casing of the preferred embodiment.

The dielectric casing 7 is used to enclose the metal shield 6 after the terminal mounting seat 8 has been retained within the latter. In this embodiment, the dielectric casing 7 includes complementary upper and lower casing parts 70, 71. With further reference to FIGS. 4 and 5, the upper casing part 70 includes a top plate 70*a* and an upper surrounding wall 70*b* depending from a periphery of the top plate 70*a*, thereby forming the upper casing part 70 with an upper recess 70*c*. The upper surrounding wall 70*b* includes opposite longitudinal portions, each having a bottom surface provided with a first locking unit in the form of a pair of first locking hooks 700, and a notched transverse portion having a bottom surface formed with a positioning groove 701. The lower casing part 71 includes a bottom plate 71*a* and a lower surrounding wall 71*b* depending from a periphery of the bottom plate 71*a*, thereby forming the lower casing part 71 with a lower recess 71*c*. The lower surrounding wall 71*b* includes opposite longitudinal portions, each having a top surface formed with a second locking unit in the form of a pair of second locking hooks 710 that complement the first locking hooks 700, and a notched transverse portion having a bottom surface formed with a pair of locating notches 711.

Figure 6:
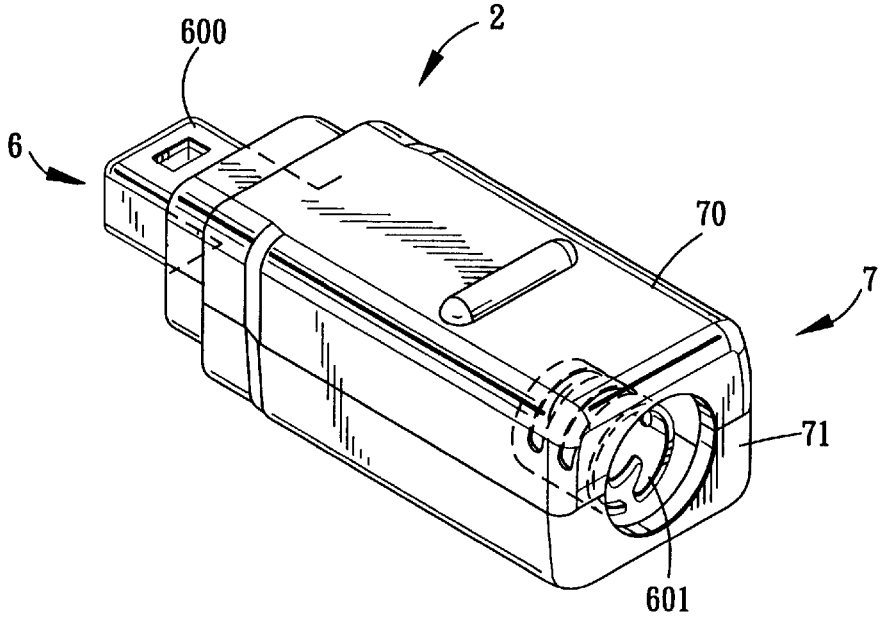
FIG. 6 is an assembled perspective view of the preferred embodiment.

To assemble the dielectric casing 7 onto the metal shield 6, the metal shield 6 is mounted on the lower casing part 71 such that the intermediate section 602 and the cable clamping section 601 of the upper shield part 60 are disposed in the lower recess 71*c*, such that the front section 600 of the upper shield part 60 extends out of the lower recess 71*c* via the notched transverse portion of the lower surrounding wall 71*b* of the lower casing part 71, and such that the locating strips 607 on the upper shield part 60 extend into the locating notches 711 in the lower casing part 71, thereby preventing horizontal sliding movement between the metal shield 6 and the lower casing part 71. Then, the upper casing part 70 is capped on the metal shield 6 such that the intermediate section 602 and the cable clamping section 601 of the upper shield part 60 are disposed in the upper recess 70*c*, such that the front section 600 of the upper shield part 60 extends out of the upper recess 70*c* via the notched transverse portion of the upper surrounding wall 70*b* of the upper casing part 70, such that the positioning projection 606 on the front section 600 of the upper shieldpart 60 extends into the positioning groove 701 in the upper casing part 70 to prevent relative movement between the metal shield 6 and the upper casing part 70 in the horizontal direction, and such that the first and second locking hooks 700, 710 interengage one another to prevent relative movement between the upper and lower casing parts 70, 71 in the vertical direction. Thus, the metal shield 6, which encloses the terminal mounting seat 8, can be stably retained inside the dielectric casing 7. Assembly of the electrical connector 2 is completed at this time, as best shown in FIG. 6.

In another preferred embodiment, instead of the two-part dielectric casing 7, a dielectric retaining ring (not shown) is sleeved fittingly around the upper and lower shield parts of the metal shield, and the resulting assembly is disposed in a mold to form a dielectric casing using known die casting techniques.

Some of the advantages arising from the electrical connector of this invention are as follows:

1. The two-part structure of the terminal mounting seat 8 involves a simpler mold design that can dramatically reduce the cost of the mold for making the same, thereby resulting in lower production costs for the electrical connector 2 of this invention.

2. Because the terminals 40 of the contact terminal set 4 are provided with angled portions 403, the distance between the cable connecting portions 401 of the terminals 40 can be greater than that between the connector mating portions 400. The larger spacing among the cable connecting portions 401 reduces the difficulty that is encountered when connecting a multi-wire cable thereto, and can minimize the occurrence of short-circuiting upon connection with the multi-wire cable.

3. Various engaging, retaining and locking units are provided among the base and cover members of the dielectric terminal mounting seat, the contact terminal set, the upper and lower shield parts of the metal shield, and the upper and lower casing parts of the dielectric casing to guard against relative movement thereamong in both the horizontal and vertical directions. Thus, the electrical connector has a very stable construction that can be prevented from undesired disengagement.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrical connector including a dielectric terminal mounting seat, a contact terminal set mounted in said terminal mounting seat, a metal shield enclosing said terminal mounting seat, and a dielectric casing enclosing said metal shield, wherein:

said terminal mounting seat includes a base member and a cover member, said base member including a bottom wall with front and rear portions, said contact terminal set being mounted on said bottom wall and extending from said front portion to said rear portion, said base member further having a top side formed with an opening, said cover member being mounted movably on said base member so as to close said opening and so as to clamp said contact terminal set against said base member;

further, wherein:

said base member further includes a pair of first side walls that extend upwardly from opposite lateral edges of said front portion of said bottom wall, and a pair of second side walls that extent upwardly from opposite lateral edges of said rear portion of said bottom wall; and said bottom wall and said first and second side walls cooperate to confine a terminal receiving cavity that extends in a longitudinal direction;

further wherein:

said first side walls have front and rear sections;

said base member further includes a top wall interconnecting top edges of said front sections of said first side walls;

said rear sections of said first side walls and said second side walls have top edges that cooperate to form said opening for access to said terminal receiving cavity; and said cover member has a front section to be disposed between said rear sections of said first side walls, and a rear section to be disposed between said second side walls;

further wherein:

said rear sections of said first side walls have confronting inner surfaces formed with a first engaging unit;

said second side walls have confronting inner surfaces formed with a second engaging unit;

said front section of said cover member has opposite lateral sides formed with a third engaging unit for engaging said first engaging unit; and said rear section of said cover member has opposite lateral sides formed with a fourth engaging unit for engaging said second engaging unit;

said first and third engaging units preventing relative movement between said base and cover members in a horizontal direction;

said second and fourth engaging units preventing relative movement between said base and cover members in a vertical direction;

further wherein:

one of said first and third engaging units includes a pair of vertically extending key grooves; and the other one of said first and third engaging units includes a pair of keys for sliding engagement with said key grooves.

2. An electrical connector including a dielectric terminal mounting seat, a contact terminal set mounted in said terminal mounting seat, a metal shield enclosing said terminal mounting seat, and a dielectric casing enclosing said metal shield, wherein:

said terminal mounting seat includes a base member and a cover member, said base member including a bottom wall with front and rear portions, said contact terminal set being mounted on said bottom wall and extending from said front portion to said rear portion, said base member further having a top side formed with an opening, said cover member being mounted movably on said base member so as to close said opening and so as to clamp said contact terminal set against said base member;

further, wherein:

said base member further includes a pair of first side walls that extend upwardly from opposite lateral edges of said front portion of said bottom wall, and a pair of second side walls that extent upwardly from opposite lateral edges of said rear portion of said bottom wall; and said bottom wall and said first and second side walls cooperate to confine a terminal receiving cavity that extends in a longitudinal direction;

further wherein:

said first side walls have front and rear sections;

said base member further includes a top wall interconnecting top edges of said front sections of said first side walls;

said rear sections of said first side walls and said second side walls have top edges that cooperate to form said opening for access to said terminal receiving cavity; and said cover member has a front section to be disposed between said rear sections of said first side walls, and a rear section to be disposed between said second side walls;

further wherein:

said rear sections of said first side walls have confronting inner surfaces formed with a first engaging unit;

said second side walls have confronting inner surfaces formed with a second engaging unit;

said front section of said cover member has opposite lateral sides formed with a third engaging unit for engaging said first engaging unit; and said rear section of said cover member has opposite lateral sides formed with a fourth engaging unit for engaging said second engaging unit;

said first and third engaging units preventing relative movement between said base and cover members in a horizontal direction;

said second and fourth engaging units preventing relative movement between said base and cover members in a vertical direction;

further wherein:

said second and fourth engaging units include complementary hook projections.

3. An electrical connector including a dielectric terminal mounting seat, a contact terminal set mounted in said terminal mounting seat, a metal shield enclosing said terminal mounting seat, and a dielectric casing enclosing said metal shield, wherein:

said terminal mounting seat includes a base member and a cover member, said base member including a bottom wall with front and rear portions, said contact terminal set being mounted on said bottom wall and extending from said front portion to said rear portion, said base member further having a top side formed with an opening, said cover member being mounted movably on said base member so as to close said opening and so as to clamp said contact terminal set against said base member;

further, wherein:

said base member further includes a pair of first side walls that extend upwardly from opposite lateral edges of said front portion of said bottom wall, and a pair of second side walls that extent upwardly from opposite lateral edges of said rear portion of said bottom wall; and said bottom wall and said first and second side walls cooperate to confine a terminal receiving cavity that extends in a longitudinal direction;

further wherein:

said first side walls have front and rear sections, said base member further includes a top wall interconnecting top edges of said front sections of said first side walls;

said rear sections of said first side walls and said second side walls have top edges that cooperate to form said opening for access to said terminal receiving cavity; and said cover member has a front section to be disposed between said rear sections of said first side walls, and a rear section to be disposed between said second side walls;

further wherein:

said base member further includes a terminal aligning wall that projects upwardly from said rear portion of said bottom wall, and that extends in a transverse direction to interconnect lower portions of said second side walls;

said terminal aligning wall has a top side formed with a plurality of terminal retaining notches; and said contact terminal set extends through said terminal aligning wall via said terminal retaining notches;

further wherein:

said rear section of said cover member has a bottom side formed with a plurality of press projections that project downwardly and that are registered with said terminal retaining notches, respectively, said press projections extending into said terminal retaining notches to clamp said contact terminal set against said base member;

further wherein:

each of said terminal retaining notches is defined by a pair of vertical walls formed with a first retaining unit; and said contact terminal set includes a plurality of terminals, each of which has a connector mating portion and a cable connecting portion, said cable connecting portion extending through a respective one of said terminal retaining notches and having opposite lateral edges formed with a second retaining unit for engaging said first retaining unit in the respective one of said terminal retaining notches;

said first and second retaining units preventing relative movement between said contact terminal set and said base member in a horizontal direction;

further wherein:

one of said first and second retaining units includes a pair of vertically extending V-shaped grooves; and the other one of said first and second retaining units includes a pair of key projections for sliding engagement with said V-shaped grooves.

4. The electrical connector as claimed in claim 3, wherein each of said press projections is configured to engage said first retaining unit in the respective one of said terminal retaining notches.

5. An electrical connector including a dielectric terminal mounting seat, a contact terminal set mounted in said terminal mounting seat, a metal shield enclosing said terminal mounting seat, and a dielectric casing enclosing said metal shield, wherein:

said terminal mounting seat includes a base member and a cover member, said base member including a bottom wall with front and rear portions, said contact terminal set being mounted on said bottom wall and extending from said front portion to said rear portion, said base member further having a top side formed with an opening, said cover member being mounted movably on said base member so as to close said opening and so as to clamp said contact terminal set against said base member;

further wherein:

said base member has opposite outer surfaces formed with a first shield retaining unit; and said metal shield includes complementary upper and lower shield parts, said lower shield part including a bottom plate and a pair of side plates that extend upwardly from opposite lateral edges of said bottom plate, said side plates being formed with a second shield retaining unit for engaging said first shield retaining unit to prevent relative movement between said base member and said lower shield part in a horizontal direction.

6. The electrical connector as claimed in claim 5, wherein:

said first shield retaining unit includes a pair of vertically extending key ways; and said second shield retaining unit includes a pair of inwardly projecting keys for sliding engagement with said key ways.

7. The electrical connector as claimed in claim 5, wherein:

said front portion of said bottom wall of said base member is narrower than said rear portion of said bottom wall in a transverse direction, thereby forming said base member with a pair of shoulders between said first and second side walls; and said side plates of said lower shield part have front ends that are bent inwardly in the transverse direction to form stop flanges that abut respectively against said shoulders of said base member.

8. The electrical connector as claimed in claim 5, wherein:

said upper shield part includes a top plate and a pair of lateral plates that extend downwardly from opposite lateral edges of said top plate;

said lateral plates extend between said side plates of said lower shield part and said terminal mounting seat, and are formed with a first shield engaging unit; and said side plates of said lower shield part are formed with a second shield engaging unit for engaging said first shield engaging unit to prevent relative movement between said upper and lower shield parts in the horizontal direction.

9. The electrical connector as claimed in claim 8, wherein:

one of said first and second shield engaging units includes a plurality of locking holes; and the other one of said first and second shield engaging units includes a plurality of resilient locking tongues that extend into and that engage said locking holes.

10. An electrical connector including a dielectric terminal mounting seat, a contact terminal set mounted in said terminal mounting seat, a metal shield enclosing said terminal mounting seat, and a dielectric casing enclosing said metal shield, wherein:

said terminal mounting seat includes a base member and a cover member, said base member including a bottom wall with front and rear portions, said contact terminal set being mounted on said bottom wall and extending from said front portion to said rear portion, said base member further having a top side formed with an opening, said cover member being mounted movably on said base member so as to close said opening and so as to clamp said contact terminal set against said base member;

further wherein:

said metal shield has a top side formed with a resilient pressing tongue for pressing against a top side of said cover member to bias said cover member toward said base member.

11. The electrical connector as claimed in claim 10, wherein said top side of said cover member is formed with an abutment projection that projects upwardly, said pressing tongue pressing against said cover member at said abutment projection.

* * * * *